US009957028B1

(12) United States Patent
O'Brien et al.

(10) Patent No.: US 9,957,028 B1
(45) Date of Patent: May 1, 2018

(54) METHODS FOR TEMPORARILY ELEVATING THE SPEED OF A MARINE PROPULSION SYSTEM'S ENGINE

(71) Applicant: Brunswick Corporation, Lake Forest, IL (US)

(72) Inventors: William P. O'Brien, Eden, WI (US); Jason S. Arbuckle, Horicon, WI (US); Andrew J. Przybyl, Berlin, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days. days.

(21) Appl. No.: 15/211,133

(22) Filed: Jul. 15, 2016

(51) Int. Cl.
*B63H 21/21* (2006.01)
*B63J 99/00* (2009.01)

(52) U.S. Cl.
CPC ..... *B63H 21/21* (2013.01); *B63H 2021/216* (2013.01); *B63J 2099/006* (2013.01)

(58) Field of Classification Search
CPC ..... B63H 21/21; B63H 2021/216; B63J 2099/006
See application file for complete search history.

(56) References Cited

U.S. PATENT DOCUMENTS 4,244,336 A 1/1981 Fitzner
4,505,169 A * 3/1985 Ganoung ..... B60W 30/18 477/100
4,939,660 A 7/1990 Newman et al.
4,986,776 A 1/1991 Hensel et al.
5,080,064 A 1/1992 Buslepp et al.
5,171,172 A 12/1992 Heaton et al.
5,836,851 A 11/1998 Ruman
5,848,582 A 12/1998 Ehlers et al.
6,009,371 A 12/1999 Kobayashi
(Continued)

FOREIGN PATENT DOCUMENTS

WO 00/68744 A1 11/2000

OTHER PUBLICATIONS

Andrasko et al., "Systems and Methods for Controlling an Electronic Throttle Valve," Unpublished U.S. Appl. No. 14/570,760, filed Dec. 15, 2014.

(Continued)

*Primary Examiner* — Behrang Badii
*Assistant Examiner* — Daniel L Greene
(74) *Attorney, Agent, or Firm* — Andrus Intellectual Property Law, LLP

(57) ABSTRACT

The speed of a marine propulsion system's engine is temporarily elevated in response to a decrease in helm demand. A controller receives a command to decrease the helm demand from a first helm demand to a second helm demand and compares a demand difference between the second helm demand and the first helm demand to a threshold demand delta. In response to the demand difference exceeding the threshold demand delta, the controller tabulates a time since the demand difference exceeded the threshold demand delta and determines an engine speed offset based upon the second helm demand and the time. The controller determines a non-elevated engine speed setpoint corresponding to the second helm demand and calculates an elevated engine speed setpoint based on the non-elevated engine speed setpoint and the engine speed offset. Engine speed is then decreased to the elevated engine speed setpoint.

20 Claims, 7 Drawing Sheets

(56) References Cited

U.S. PATENT DOCUMENTS

| | | | | |
|---|---|---|---|---|
| 6,152,102 | A | 11/2000 | Ruman | |
| 6,152,104 | A | 11/2000 | Vorih et al. | |
| 6,273,771 | B1 | 8/2001 | Buckley et al. | |
| 6,298,824 | B1 * | 10/2001 | Suhre | F02D 37/02 123/406.49 |
| 6,425,370 | B1 | 7/2002 | Kramer | |
| 6,561,016 | B1 | 5/2003 | Suhre et al. | |
| 6,587,765 | B1 | 7/2003 | Graham et al. | |
| 6,701,890 | B1 | 3/2004 | Suhre et al. | |
| 6,757,606 | B1 | 6/2004 | Gonring | |
| 7,163,000 | B2 | 1/2007 | Ishida et al. | |
| 7,357,120 | B2 | 4/2008 | Kaji | |
| 7,422,501 | B2 | 9/2008 | Mizushima et al. | |
| 7,473,149 | B2 | 1/2009 | Mizokawa | |
| 7,549,407 | B2 | 6/2009 | Krupadanam | |
| 7,556,547 | B2 | 7/2009 | Kaji | |
| 7,917,283 | B2 | 3/2011 | Kado | |
| 7,976,354 | B2 | 7/2011 | Kubota et al. | |
| 8,340,847 | B2 | 12/2012 | Sako et al. | |
| 8,439,800 | B1 | 5/2013 | Bazan et al. | |
| 8,762,022 | B1 * | 6/2014 | Arbuckle | B63H 21/21 114/102.1 |
| 9,039,468 | B1 | 5/2015 | Arbuckle et al. | |
| 9,145,839 | B1 | 9/2015 | Andrasko | |
| 9,156,536 | B1 | 10/2015 | Arbuckle et al. | |
| 9,248,898 | B1 | 2/2016 | Kirchhoff et al. | |
| 9,381,989 | B1 | 7/2016 | Poirier | |
| 2002/0086593 | A1 | 7/2002 | Shidara et al. | |
| 2003/0000500 | A1 | 1/2003 | Chatfield | |
| 2003/0019414 | A1 * | 1/2003 | Borrett | B63H 11/11 114/144 B |
| 2003/0027468 | A1 | 2/2003 | Into | |
| 2003/0054704 | A1 | 3/2003 | Kanno | |
| 2003/0109184 | A1 | 6/2003 | Kanno | |
| 2003/0120360 | A1 | 6/2003 | Yasui et al. | |
| 2004/0069271 | A1 | 4/2004 | Kanno et al. | |
| 2004/0069272 | A1 | 4/2004 | Allen et al. | |
| 2005/0161022 | A1 | 7/2005 | Kishi et al. | |
| 2006/0047406 | A1 | 3/2006 | Chatfield et al. | |
| 2006/0118086 | A1 | 6/2006 | Schwulst et al. | |
| 2006/0166573 | A1 | 7/2006 | Vetta et al. | |
| 2008/0051979 | A1 | 2/2008 | Yasui et al. | |
| 2008/0124989 | A1 | 5/2008 | Sturdy et al. | |
| 2008/0280511 | A1 | 11/2008 | Kado | |
| 2009/0037073 | A1 | 2/2009 | Jung et al. | |
| 2010/0191397 | A1 | 7/2010 | Nose et al. | |
| 2011/0202258 | A1 | 8/2011 | Fukushima et al. | |
| 2011/0297462 | A1 | 12/2011 | Grajkowski et al. | |
| 2012/0191275 | A1 | 7/2012 | Clever et al. | |
| 2013/0035009 | A1 | 2/2013 | Kuriyagawa et al. | |
| 2013/0047957 | A1 * | 2/2013 | Breuer | F02D 41/10 123/406.14 |
| 2014/0244130 | A1 * | 8/2014 | Filev | B60K 31/00 701/96 |
| 2015/0000636 | A1 * | 1/2015 | Stockbridge | B60H 1/3222 123/350 |

OTHER PUBLICATIONS

Arbuckle et al., "Systems and Methods for Setting Engine Speed Using a Feed Forward Signal," Unpublished U.S. Appl. No. 14/573,202, filed Dec. 17, 2014.

Arbuckle et al., "Systems and Methods for Setting Engine Speed in a Marine Propulsion Device," Unpublished U.S. Appl. No. 14/610,377, filed Jan. 30, 2015.

Newport, Motion Control Coordinate System, www.newport.com, pp. 7-2 through 7-25, website visited Nov. 18, 2014.

* cited by examiner

% TOTAL HELM DEMAND

| | 0 | 5 | 10 | 15 | 20 | ... |
|---|---|---|---|---|---|---|
| PSEUDO BOAT SPEED (PBS) | a | b | c | d | e | ... |

TIME SINCE THROTTLE CHOP

PBS AT TIME OF THROTTLE CHOP

| | 1 | 2 | 3 | 4 |
|---|---|---|---|---|
| 10 | a | b | c | d |
| 20 | e | f | g | h |
| 30 | i | j | k | l |
| 40 | m | n | o | p |
| 50 | q | r | s | t |
| 60 | u | v | w | x |

FIG. 3

METHODS FOR TEMPORARILY ELEVATING THE SPEED OF A MARINE PROPULSION SYSTEM'S ENGINE

FIELD

The present disclosure relates to marine propulsion systems for use on marine vessels, and more specifically to systems and methods for setting an engine speed of an internal combustion engine of a marine propulsion device in a marine propulsion system.

BACKGROUND

Each of the below U.S. Patents and Patent Applications are hereby incorporated by reference herein in their entirety.

U.S. Pat. Nos. 8,762,022 and 9,156,536 disclose systems and methods for efficiently changing controlled engine speed of a marine internal combustion engine in a marine propulsion system for propelling a marine vessel. The system responds to the operator changing the operator-selected engine speed, from a first-selected engine speed to a second-selected engine speed, by predicting throttle position needed to provide the second-selected engine speed, and providing a feed forward signal moving the throttle to the predicted throttle position, without waiting for a slower responding PID controller and/or overshoot thereof, and concomitant instability or oscillation, and then uses the engine speed control system including any PID controller to maintain engine speed at the second-selected engine speed.

Unpublished U.S. patent application Ser. No. 14/570,760, filed Dec. 15, 2014, discloses a method for controlling a position of an electronic throttle valve of an internal combustion engine. The method includes determining a desired throttle valve position; determining a first feed forward signal based on a rate of change between a previous throttle valve position and the desired throttle valve position; and determining a second feed forward signal based on a comparison of the desired throttle valve position to a limp home position of the throttle valve, in which the throttle valve is biased open by a spring. A summation of the first and second feed forward signals is used to actuate the throttle valve. After the throttle valve has been actuated according to the first and second feed forward signals, the position of the throttle valve is controlled with a feedback controller to obtain the desired throttle valve position.

Unpublished U.S. patent application Ser. No. 14/573,202, filed Dec. 17, 2014, discloses a method for setting an engine speed of an internal combustion engine in a marine propulsion system to an operator-selected engine speed. The method includes predicting a position of a throttle valve of the engine that is needed to provide the operator-selected engine speed, and determining a feed forward signal that will move the throttle valve to the predicted position. After moving the throttle valve to the predicted position, the method next includes controlling the engine speed with a feedback controller so as to obtain the operator-selected engine speed. The feed forward signal is determined based on at least one of the following criteria: an operator-selected control mode of the marine propulsion system and an external operating condition of the marine propulsion system. A system for setting the engine speed to the operator-selected engine speed is also described.

Unpublished U.S. patent application Ser. No. 14/610,377, filed Jan. 30, 2015, discloses a method for setting an engine speed of an internal combustion engine in a marine propulsion device of a marine propulsion system to an engine speed setpoint. The method includes determining the engine speed setpoint based on an operator demand and predicting a position of a throttle valve that is needed to achieve the engine speed setpoint. The method also includes determining a feed forward signal that will move the throttle valve to the predicted position, and after moving the throttle valve to the predicted position, adjusting the engine speed with a feedback controller so as to obtain the engine speed setpoint. An operating state of the marine propulsion system is also determined. Depending on the operating state, the method may include determining limits on an authority of the feedback controller to adjust the engine speed and/or determining whether the operator demand should be modified prior to determining the engine speed setpoint.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure is of a method for temporarily elevating a speed of an engine in a marine propulsion system in response to a decrease in helm demand. The method includes receiving, with a controller, a command to decrease the helm demand from a first helm demand to a second helm demand and comparing a demand difference between the second helm demand and the first helm demand to a threshold demand delta. In response to the demand difference exceeding the threshold demand delta, the method includes tabulating a time since the demand difference exceeded the threshold demand delta and determining an engine speed offset based upon the second helm demand and the time. The controller determines a non-elevated engine speed setpoint corresponding to the second helm demand and calculates an elevated engine speed setpoint based on the non-elevated engine speed setpoint and the engine speed offset. The method includes decreasing the engine speed to the elevated engine speed setpoint.

According to another example of the present disclosure, a method for temporarily elevating a speed of an engine in a marine propulsion system in response to a decrease in helm demand is disclosed. The method includes receiving, with a controller, a command to decrease the helm demand from a first helm demand to a second helm demand and comparing a demand difference between the second helm demand and the first helm demand to a threshold demand delta. The controller determines if the marine propulsion system is operating in a given mode. In response to the demand difference exceeding the threshold demand delta and the marine propulsion system operating in the given mode, the controller then tabulates a time since the demand difference exceeded the threshold demand delta. The controller determines an engine speed offset based upon the second helm demand and the time and determines a non-elevated engine speed setpoint corresponding to the second helm demand. The method includes calculating an elevated engine speed setpoint based on the non-elevated engine speed setpoint and the engine speed offset and decreasing the engine speed to the elevated engine speed setpoint.

Another method for temporarily elevating a speed of an engine in a marine propulsion system in response to a decrease in helm demand is disclosed as a further example. A controller receives a command to decrease the helm demand from a first helm demand to a second helm demand and compares a demand difference between the second helm demand and the first helm demand to a threshold demand delta. In response to the demand difference exceeding the threshold demand delta, the method includes tabulating a time since the demand difference exceeded the threshold demand delta and determining an engine speed offset based upon the second helm demand and the time. The method also includes determining a non-elevated engine speed setpoint corresponding to the second helm demand. The controller calculates an elevated engine speed setpoint based on the non-elevated engine speed setpoint and the engine speed offset and decreases the engine speed to the elevated engine speed setpoint. The method includes subsequently determining if the helm demand remains at the second helm demand and, as long as the helm demand remains at the second helm demand, filtering the engine speed offset and re-calculating the elevated engine speed setpoint based on the non-elevated engine speed setpoint and the filtered engine speed offset. In response to a command to increase the helm demand to a subsequent helm demand, the controller determines when to transition from setting the engine speed to the elevated engine speed setpoint to setting the engine speed to the non-elevated engine speed setpoint based on whether the second helm demand is above or below an idle threshold.

BRIEF DESCRIPTION OF THE DRAWINGS

The present disclosure is described with reference to the following Figures. The same numbers are used throughout the Figures to reference like features and like components.

FIG. 3 illustrates one example of an engine speed offset lookup table according to the present disclosure.

DETAILED DESCRIPTION

In the present description, certain terms have been used for brevity, clarity, and understanding. No unnecessary limitations are to be inferred therefrom beyond the requirement of the prior art because such terms are used for descriptive purposes only and are intended to be broadly construed. Each of the examples of systems and methods provided in the figures and in the following description can be implemented separately, or in conjunction with one another and/or with other systems and methods.

Figures 1, 2:
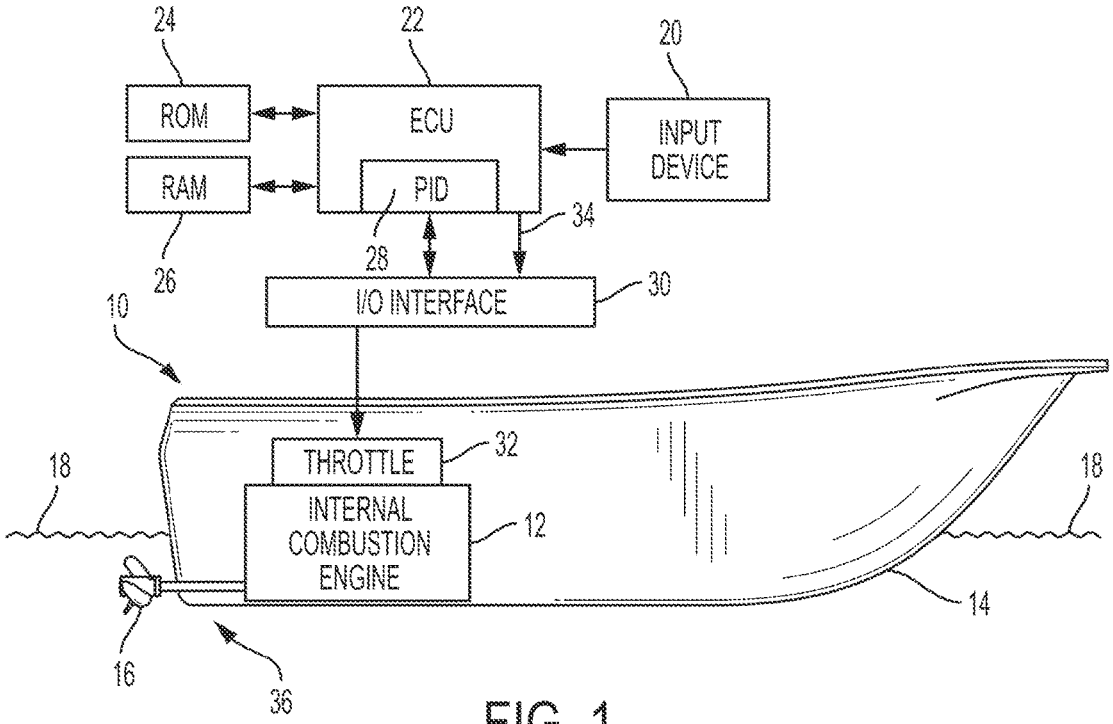
FIG. 1 illustrates a marine propulsion system according to the present disclosure.
FIG. 2 illustrates one example of a pseudo boat speed lookup table according to the present disclosure.

FIG. 1 shows a marine propulsion system 10 having an internal combustion engine 12 for propelling a marine vessel 14, for example by way of a propeller 16, in a body of water 18. Together, the engine 12 and propeller 16 shown herein make up an inboard marine propulsion device 36. However, it should be understood that the present system 10 could instead include an outboard propulsion device, a stern drive, a pod drive, a jet drive, etc. A desired speed of the engine 12 can be set by the operator of the marine vessel 14 by way of an input device 20, such as a throttle lever, joystick, keypad, touchscreen, or the like. Engine speed could instead be set automatically by one or more automatic navigation systems serving as the input device 20, such as an autopilot system, an electronic anchoring system, a waypoint tracking system, an electronic docking system, etc. Because the above-noted input devices are generally located near the helm of the marine vessel 14, the engine speed command initiated by or at the input device 20 can be called a "helm demand."

A controller such as an electronic control unit (ECU) 22 receives the helm demand from the input device 20 and includes appropriate read only memory (ROM) 24 and random access memory (RAM) 26, computer code, and a processor for determining an engine speed setpoint based on the helm demand and processing the engine speed setpoint with a feedback controller 28, such as a proportional integral derivative (PID) controller or a PI controller. By way of example, the helm demand as determined by a transducer in the base of a throttle lever can be sent to a lookup table to look up an engine speed setpoint. The difference between the engine speed setpoint and the actual engine speed is then provided to feedback controller 28, which outputs a control signal to input-output (I/O) interface 30, which in turn supplies a control signal to internal combustion engine 12, including throttle valve 32, which controls engine speed according to throttle position. By way of control with the feedback controller 28, the ECU 22 maintains engine speed at the operator-selected engine speed.

In response to the operator changing the helm demand/operator-selected engine speed at input device 20 from a first helm demand/first-selected engine speed to a second helm demand/second-selected engine speed, the ECU 22 makes a prediction as to the position of the throttle valve 32 needed to provide the second-selected engine speed. For example, the engine speed setpoint can be provided to another lookup table to look up a feed forward signal. The ECU 22 then provides the feed forward signal at 34 to the I/O interface 30, which feed forward signal 34 bypasses feedback controller 28 and moves throttle valve 32 to the predicted throttle valve position. For example, the ECU 22 outputs the feed forward signal 34 to a throttle valve actuator, such as a motor geared to the throttle valve 32.

After movement of the throttle valve 32 to the predicted throttle valve position, the feedback controller 28 corrects the position of the throttle valve 32 as needed so as to obtain and maintain the engine speed at the second operator-selected engine speed. The throttle valve 32 is therefore moved to the predicted throttle position in response to the feed forward signal 34, without waiting for the input of the feedback controller 28 to move the throttle valve 32, thereby decreasing or eliminating overshoot. The system thereby enables reduction of amplification gain of the feedback controller 28 that would otherwise be needed to accommodate the change from the first-selected engine speed to the second-selected engine speed from input device 20, and instead accommodates such change by the predicted throttle position provided by the feed forward signal 34. Such reduced amplification gain provides enhanced stability of the feedback controller 28 and reduces oscillation of the system 10.

The ECU 22 may include a memory (ROM 24, RAM 26) and a programmable processor. As is conventional, the processor can be communicatively connected to a computer readable medium that includes volatile or nonvolatile memory upon which computer readable code is stored. The processor can access the computer readable code, and the computer readable medium upon executing the code carries out functions as described herein below. In other examples of the system 10, more than one controller is provided, rather than the single ECU 22 as shown herein. For example, a first controller could be provided in order to interpret signals sent from the helm of the marine vessel 14, and a second controller could be provided for the marine propulsion device 36. It should be noted that the lines shown in FIG. 1 are meant to show only that the various elements in the system 10 are capable of communicating with one another, and do not represent actual wires connecting the elements, nor do they represent the only paths of communication between the elements. Further, the communications shown herein could be wired (for example, via a serially wired CAN bus) or wireless.

Prior art systems have been used in discreet idle PID regions for shift stall abatement and other scenarios where a temporary elevation of engine idle speed versus vessel speed (real or inferred) is desired. Such prior art systems can apply an engine speed offset when traditional idle control is enabled. Adding an offset to the engine speed is important when the user chops the throttle from a first, relatively higher helm demand to a second, relatively lower helm demand. When a throttle chop occurs, it is assumed that the vessel operator will likely shift into reverse soon thereafter. In other words, it is assumed that a throttle chop is made in order to avoid an obstacle nearing the marine vessel. In such a "panic shift" situation, the engine speed would first drop from that associated with the first helm demand to that associated with the second helm demand (which is likely at idle or near idle), then would jump up to a relatively higher engine speed as the throttle lever is shifted through neutral into reverse. Dropping the engine speed down to idle or near-idle and then increasing it as the system is subsequently shifted into reverse will likely cause the engine to stall. Therefore, during such a panic shift, it is helpful to retard spark while keeping the throttle valve 32 relatively open, in order to maintain a volume of air in the intake plenum that is capable of handling an instantaneous load change from neutral to reverse gear. By maintaining the throttle valve 32 in a position that is more open than it would normally be, once the spark is in fact ignited, there will be a higher torque available from the engine 12 for operation in reverse gear. Commanding an artificially high engine speed when in idle or near-idle (or even in higher engine speed ranges) after a significant throttle chop allows a larger volume of air to be maintained in the intake plenum.

Figure 8:
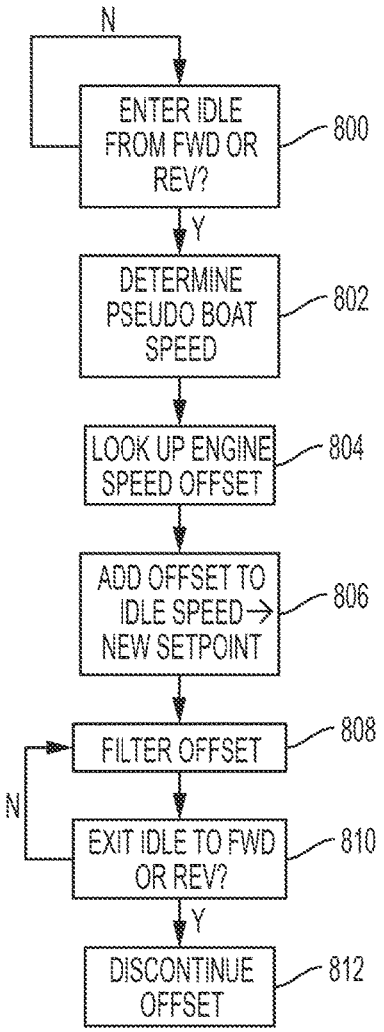
FIG. 8 PRIOR ART
FIG. 8 illustrates a prior art strategy for temporarily elevating an idle speed of an engine in a marine propulsion system.

Some prior art systems apply the offset versus a calculated (i.e., "pseudo") boat speed. The offset is determined using a one dimensional table with the look up value being controlled by a calibrated first order filter. In other words, an input pseudo boat speed will return an output engine speed offset. The offset can be abruptly discontinued when the system exits idle. For example, referring to FIG. 8, if a marine propulsion system enters idle from forward or reverse, as shown at 800, an exemplary prior art method may include determining a pseudo boat speed, as shown at 802. The pseudo boat speed may then be used to look up the engine speed offset, as shown at 804. As shown at 806, the offset can be added to the idle speed in order to determine a new, temporarily elevated engine speed setpoint, as shown at 806. The offset is thereafter filtered, as shown at 808, such that it exponentially decreases over time, until eventually the engine is operating at its base idle speed. As shown at 810, if before the offset has been filtered out, the system exits idle to forward or reverse, the offset may be discontinued (deleted), as shown at 812.

Such prior art methods work well in systems where the command from the input device 20 translates directly to a position of the throttle valve 32, and engine speed is a result of throttle valve position, in contrast to the system described herein above with respect to FIG. 1, in which the input device 20 commands an operator-selected engine speed. Utilizing a traditional idle control offset method with systems in which in which helm demand is directly correlated to an engine speed setpoint and the position of the throttle valve 32 is controlled via a feedback controller 28 to maintain the engine speed setpoint can result in speed discontinuities that are objectionable to a vessel operator. For example, in a system like that described herein above with respect to FIG. 1, the offset will remain in the engine speed calculations even after a command to drive off of idle is received. This results in the operator noticing an uncommanded speed change later on, once the offset has been filtered out. The method of the present disclosure therefore takes different actions depending on whether the helm demand is chopped from an off-idle speed to a lower off-idle speed or whether the throttle is chopped from an off-idle speed to an on-idle speed. The method of the present disclosure also provides solutions to situations in which helm demand is subsequently increased after having been decreased to the second, lower helm demand.

FIG. 2 provides an exemplary look up table that shows how pseudo boat speed can be calculated. Using a throttle lever as the exemplary input device 20, it is understood that the throttle lever can be moved from a position corresponding to 0% helm demand (idle) to a position corresponding to 100% helm demand (full speed). Each given percentage of total helm demand requested via the throttle lever can be correlated to a different pseudo boat speed (PBS) that approximates the boat's speed when the engine 12 is operating at a speed corresponding to the given helm demand. For example, as shown in the table in FIG. 2, for a helm demand of 10%, the pseudo boat speed returned would be "c". In one example, the pseudo boat speed values are all slightly higher than the helm demand values to which they correspond up until about 60% of total helm demand, after which the pseudo boat speed values may be slightly lower than the helm demand values to which they correspond. The pseudo boat speed values can be calibrated values that depend on the type of vessel, type of marine propulsion device, etc. For helm demand inputs between the values listed in the table, the returned value of pseudo boat speed can be extrapolated based on a linear or exponential relationship, depending on calibration. In other examples, the pseudo boat speed values may be calculated, rather than determined from a table as in FIG. 2. For example, the ECU 22 could accept input regarding the current fuel flow, current throttle position, current air flow, etc. and could calculate an estimated boat speed based on these measured values.

Figure 9:
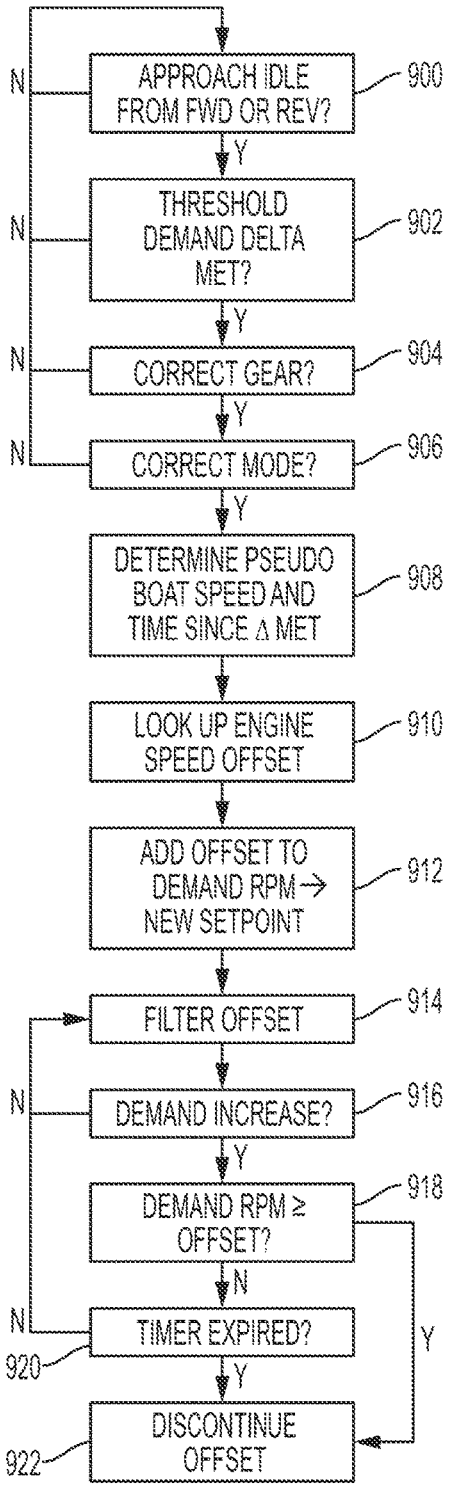
FIG. 9 illustrates an overview of a method according to the present disclosure for temporarily elevating a speed of an engine in a marine propulsion system.

FIG. 9 shows an overview of an engine speed offset method according to the present disclosure, which will be described in more detail herein below. As shown at 900, if the system approaches idle from forward or reverse, the present method may include determining if a threshold helm demand Δ has been met, as shown at 902. (This is in contrast to prior art methods, in which the engine speed offset method was invoked upon entry into idle. See box 800, FIG. 8.) If yes at box 902, the method may include determining whether the system is in a given gear, as shown at 904. If yes, the method may include determining whether the system is in a given mode, as shown at 906. If yes, the method may include determining the pseudo boat speed and the time since the threshold demand Δ was met, as shown at 908, and using these values to look up an engine speed offset, as shown at 910. Note that any of 902, 904, or 906 can be performed at the same time, or they can be performed in a different order than that shown herein. Note also that if any of these conditions is not true, the engine speed offset method will not be enabled.

The method may next include adding the offset to an engine speed corresponding to the current helm demand in order to obtain an elevated engine speed setpoint, as shown at 912. Note that the "elevated" engine speed setpoint will be higher than what the current helm demand would otherwise dictate, but will still be lower than the engine speed associated with the original helm demand. As shown at 914, the method may then continue with filtering the offset. Meanwhile, the method may include determining whether the helm demand has increased, as shown at 916. As shown at 918, the method may include determining whether the engine speed corresponding to the new, increased helm demand is greater than or equal to the current elevated engine speed (which includes the offset), as shown at 918. The method may also include determining whether a timer has expired on the filter, as shown at 920. If either of 918 or 920 is true, the method may include discontinuing offsetting the engine speed setpoint, as shown at 922. If either of 916 or 920 is not true, the offset may be filtered until, for example, the engine speed reaches the base engine speed corresponding to the helm demand.

As noted at 902 in FIG. 9, invocation of the present engine speed offset strategy and calculation of an engine speed offset might be invoked only upon a demand difference between a second helm demand and a first helm demand being greater than a threshold demand Δ. Once this threshold demand Δ has been achieved, the offset may be calculated according to a pseudo boat speed value captured at the time of the throttle chop that met the threshold demand Δ and according to the time that lapsed since the demand Δ was met. One example of how such variables can be used to determine an engine speed offset is shown by the lookup table provided in FIG. 3. For example, for a pseudo boat speed of 40%, (e.g., determined by inputting the second helm demand to the table of FIG. 2), and a time since throttle chop of one second, the output offset might be the value "m." The offset would thereafter be filtered according to a calibrated first order filter, such that by two seconds after the throttle chop, the offset decreases to "n"; by three seconds after the throttle chop, the offset decreases to "O"; by four seconds after the throttle chop, the offset decreases to "p"; and so on, until the offset has been decreased to 0 RPM (i.e., the filter timer expires). The rate of the throttle chop may be taken into account according to the different pseudo boat speeds at the time of throttle chop shown in the columns of the table of FIG. 3, wherein an offset value may be higher for a pseudo boat speed at the time of throttle chop of 60% than for a pseudo boat speed at the time of throttle chop of 10%, given the same amount of time since the throttle chop. Thus, an initial value of the engine speed offset is directly related to the second helm demand (by way of the pseudo boat speed determined from the table in FIG. 2), such that a higher second helm demand corresponds to a higher initial offset than would a lower second helm demand.

Figure 4:
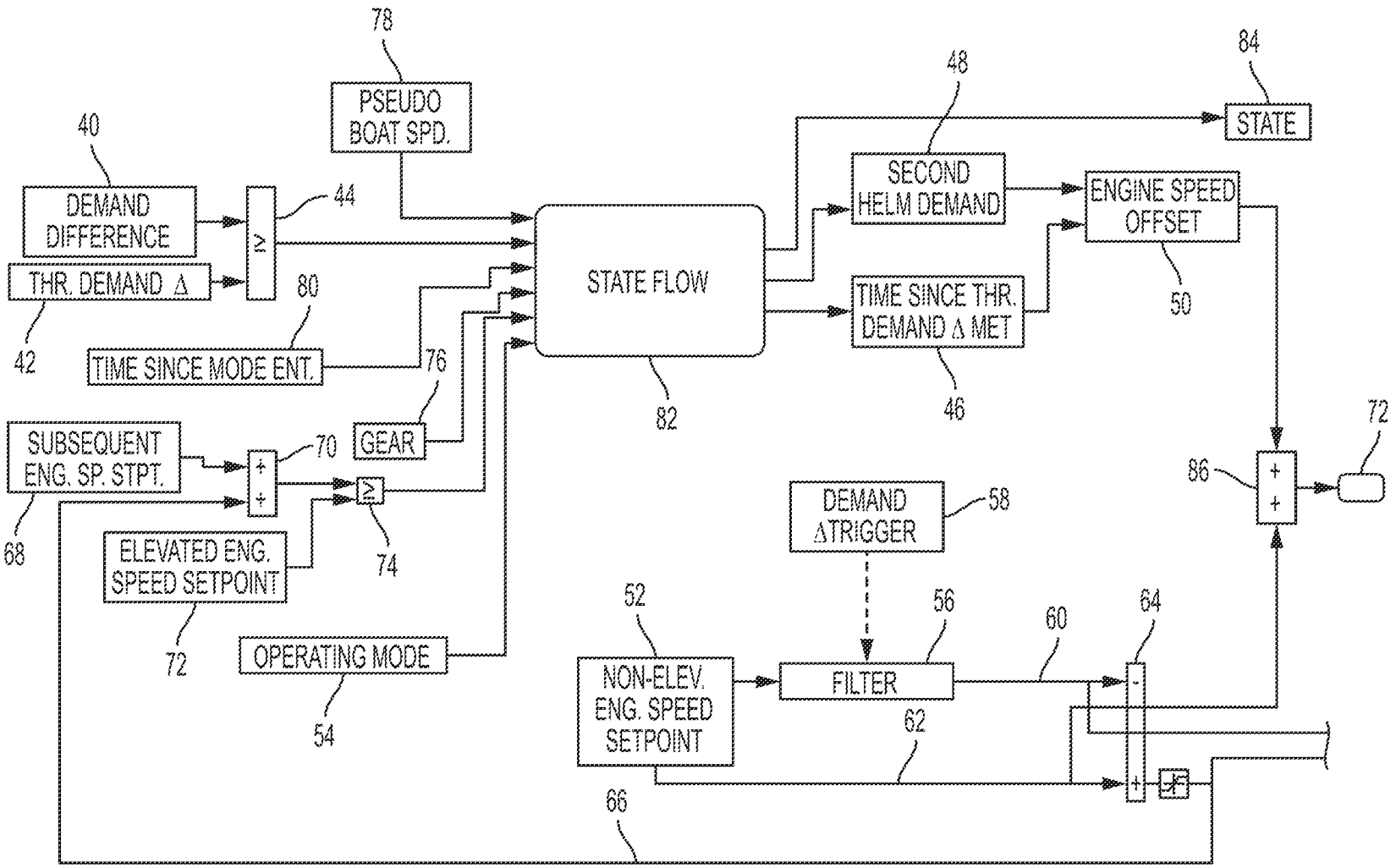
FIG. 4 illustrates one example of a logic diagram for carrying out a method according to the present disclosure.
Figure 5:
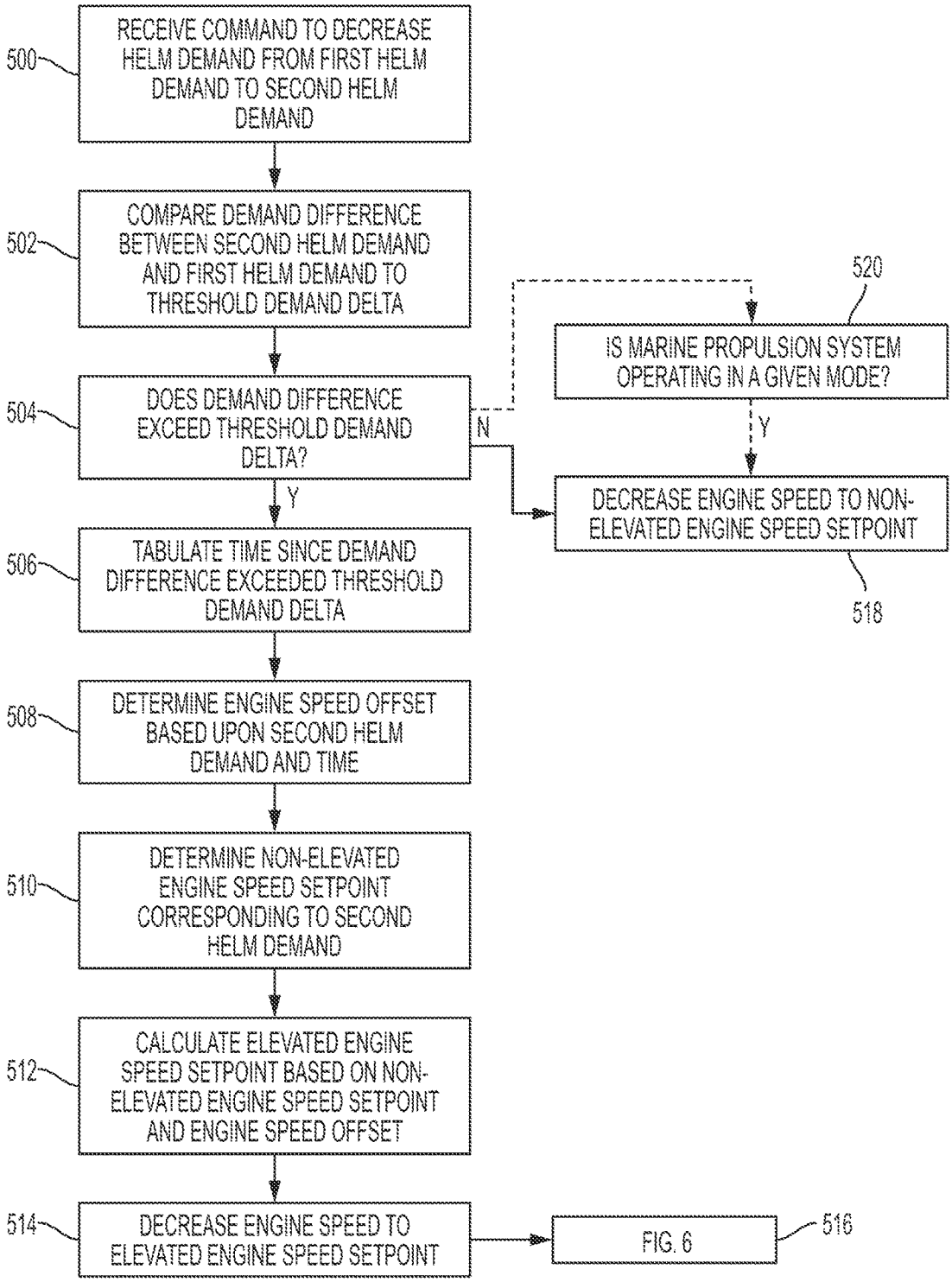
FIG. 5 illustrates one method for temporarily elevating a speed of an engine in a marine propulsion system in response to a decrease in helm demand.

FIGS. 4 and 5 will now be used to describe a method according to the present disclosure in more detail. FIG. 4 is a logic diagram showing the inputs to the system and calculated outputs from the system that determine whether the engine speed offset algorithm is to be used, and if so, what the offset value should be. FIG. 5 is a flow diagram showing a portion of a method according to the present disclosure for temporarily elevating a speed of an engine 12 in a marine propulsion system 10 in response to a decrease in helm demand. Referring to FIG. 5, at 500, the method includes receiving, with a controller 22, a command to decrease the helm demand from a first helm demand to a second helm demand. The input of the demand difference between the second and first helm demands to the system is shown at 40 in FIG. 4. As shown at 502, the method also includes comparing the demand difference between the second helm demand and the first helm demand to a threshold demand Δ. The threshold demand Δ may be a calibrated value, and is shown as being input into the system at 42 in FIG. 4. The method next includes determining if the demand difference exceeds the threshold demand Δ, as shown at 504. This comparison is also shown at 44 in FIG. 4.

In response to the demand difference exceeding the threshold demand Δ, the method further includes tabulating a time since the demand difference exceeded the threshold demand Δ, as shown at 506. The input of this tabulated time to the system is shown at 46 in FIG. 4. The method continues with determining the engine speed offset based upon the second helm demand and the time, as shown at 508. For example, referring to FIGS. 2-4, the second helm demand 48 can be input into a table such as that shown in FIG. 2 to determine the PBS 78, and the PBS 78 and the time since the threshold demand Δ has been met 46 can be input into a table such as that shown in FIG. 3 in order to calculate the engine speed offset 50. The method may also include determining a non-elevated engine speed setpoint corresponding to the second helm demand, as shown at 510. This may be done as described herein above with respect to FIG. 1, where a certain position of the throttle lever (or other command from another type of input device 20) corresponds to a calibrated desired engine speed. Such input to the system is shown at 52 in FIG. 4. Note that box 510 can be performed before or simultaneously with boxes 502, 504, 506, and/or 508.

The method may next include, as shown at 512, calculating an elevated engine speed setpoint based on the non-elevated engine speed setpoint (from box 510) and the engine speed offset (from box 508). For example, the non-elevated engine speed setpoint 52 and the engine speed offset 50 may be added together at summer 86 to determine the elevated engine speed setpoint 72. The controller 22 may thereafter manipulate the throttle valve 32 in order to decrease the engine speed to the elevated engine speed set point, as shown at 514. Feedback control over the elevated engine speed setpoint can thereafter be carried out so long as the helm demand has not changed. For example, the method may include, as described herein above with respect to FIG. 1, predicting a position of the throttle valve 32 of the engine 12 that is needed to achieve the elevated engine speed setpoint, determining a feed forward signal that will move the throttle valve 32 to the predicted position, and after moving the throttle valve 32 to the predicted position, adjusting the engine speed with a feedback controller 28 so as to obtain the elevated engine speed setpoint.

Returning to the decision made at box 504 regarding whether the demand difference exceeds the threshold demand Δ, if the answer is no, the method may further include decreasing the engine speed to the non-elevated engine speed setpoint corresponding to the second helm demand, as shown at 518. (Recall that the non-elevated engine speed setpoint is determined at box 510, which can be performed before or simultaneously with steps 502 and/or 504.) In other words, if the threshold demand Δ has not been met, the engine speed offset strategy is not enabled, and the engine speed is set to that corresponding to the second helm demand from input device 20. In this instance, it is assumed that a panic shift is not occurring, because the decrease in helm demand is not great enough (i.e., has not met the threshold).

Alternatively, after determining that the demand difference does not exceed the threshold demand Δ (box 504), the method may further comprise determining if the marine propulsion system 10 is operating in a given mode, as shown at 520. If the marine propulsion system 10 is not operating in the given mode, the method may further include setting the engine speed to the non-elevated engine speed setpoint corresponding to the second helm demand, as shown at 518. Note that the determination made at 520 could alternatively be made before the determination made at 504, as either condition not being met is enough to prevent the engine speed offset strategy from continuing, resulting in the engine speed being decreased to the non-elevated engine speed setpoint. Requiring the system to be in a given mode before the engine speed offset strategy is enabled allows for discreet application of the strategy when desired and/or needed. This is important because advanced control modes, such as but not limited to joysticking mode, electronic anchoring mode, waypoint tracking mode, autopilot mode, docking mode, etc., can interact in both good and bad ways with the engine speed offset strategy. Whether a particular mode mentioned herein above is one of the given modes required for operation of the engine speed offset strategy can be programmed by the calibrator. Because some modes transition between helm demand sources while the particular mode is active, the method may include a latching strategy to latch a given mode for a specified period of time.

For example, the system may normally be in an unlatched state. The system may transition to a "non-wheel" mode anytime the helm demand is commanded by an input device 20 that is not the throttle lever. The system will latch the current non-wheel helm demand source if the mode thereafter transitions to "wheel" mode, in which the helm demand is commanded by the throttle lever. It will remain in the latched state until the mode transitions back to a non-wheel mode or until a predetermined threshold latch time is exceeded, whichever occurs first. Thus, the method includes decreasing the engine's speed to the non-elevated engine speed setpoint corresponding to the second helm demand (i.e., discontinuing the engine speed offset strategy) in response to the marine propulsion system 10 not operating in the given mode (in this example, non-wheel) for longer than a threshold latch time after having previously operated in the given mode. Note that the latching logic does not disable a currently-enabled instance of the engine speed offset strategy. This is purposeful, because as mentioned above, certain systems may change the source of helm demand with activation and deactivation of certain types of input devices. For example, activation and deactivation of a joystick would not necessarily result in the system transitioning out of the wheel mode. The output of the entire determination of whether the system is in a given mode that will allow or prevent activation of the engine speed offset strategy is shown in FIG. 4 at 54.

Figure 6:
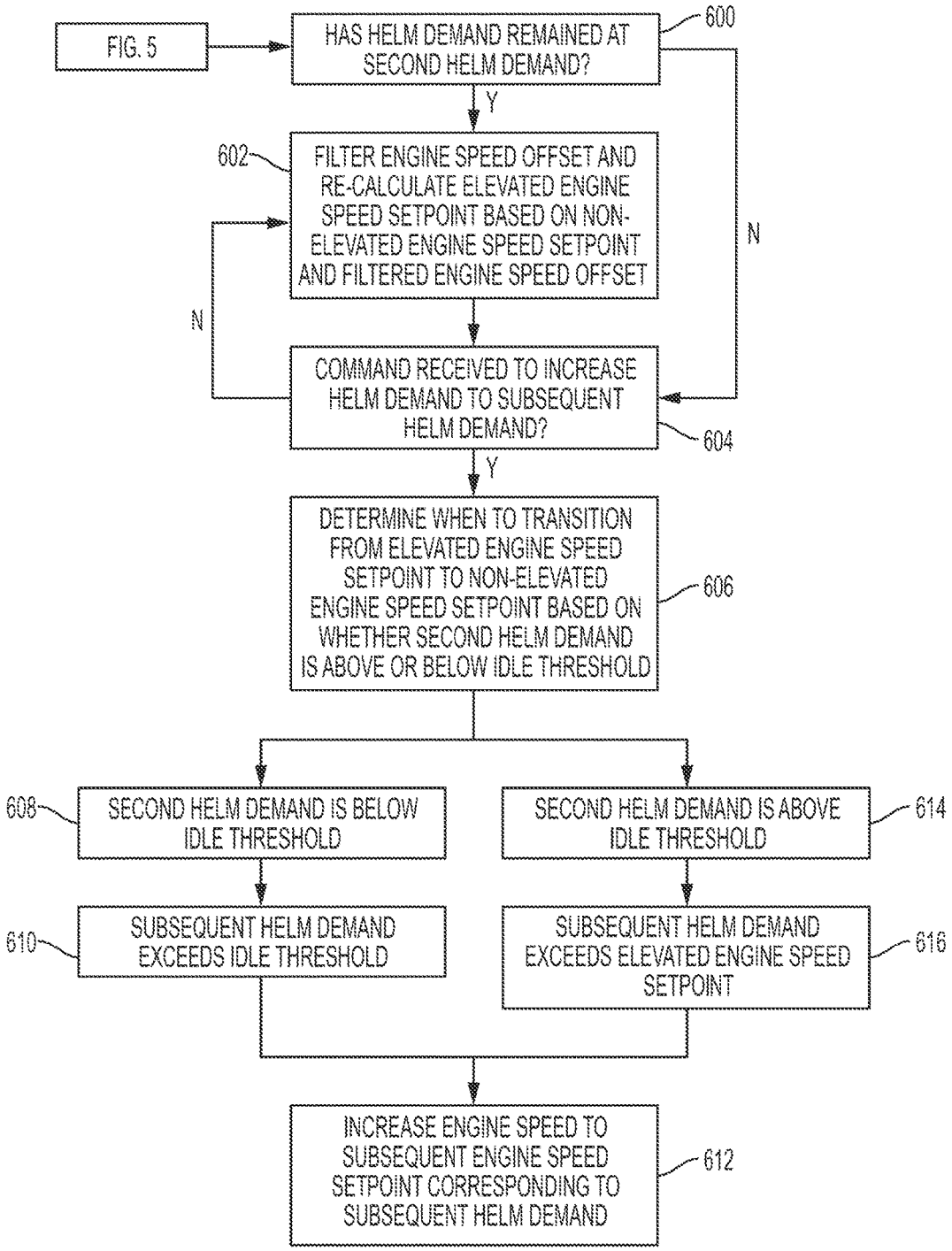
FIG. 6 illustrates a continuation of the method of FIG. 5.

If the method included decreasing the engine speed to the elevated engine speed setpoint as shown at 514, the method thereafter continues to box 516 of FIG. 5 and into FIG. 6. As shown in FIG. 6, the method may include determining if the helm demand remains at the second helm demand, as shown at 600, and as long as the helm demand remains at the second helm demand, filtering the engine speed offset and recalculating the elevated engine speed setpoint based on the non-elevated engine speed setpoint and the filtered engine speed offset, as shown at 602. Such filtering can be done according to the table shown in FIG. 3, where, as the time since throttle chop increases for a given PBS at time of throttle chop, the offset decreases. On the other hand, the below description will discuss instances in which the operator has decreased the helm demand from a first, higher helm demand to a second, lower helm demand, and thereafter increases the helm demand to a subsequent helm demand, which may be either in forward or reverse gear, but requires an engine speed that is higher than that of the second helm demand. For example, if a command is received to increase helm demand to a subsequent helm demand, as shown at 604, the method may include determining when to transition from the elevated engine speed setpoint to the non-elevated engine speed setpoint in response to a command to increase the helm demand to a subsequent helm demand based on whether the second helm demand is above or below an idle threshold by comparing the second helm demand to the idle threshold, as shown 606.

If the second helm demand is below the idle threshold, as shown at 608, and the helm demand thereafter increases, the method further comprises continuing to recalculate the elevated engine speed setpoint based on the non-elevated engine speed setpoint and the filtered engine speed offset (see FIG. 3 and box 602) until a command to increase the helm demand to a subsequent helm demand that exceeds the idle threshold is received. Once a subsequent helm demand that exceeds the idle threshold is received, as shown at 610, the method may include increasing the engine speed to a subsequent engine speed setpoint corresponding to the subsequent helm demand, as shown at 612. The subsequent engine speed setpoint would be determined as described with respect to FIG. 1 herein above, in which a position of the throttle lever (or other helm demand from another type of input device 20) corresponds directly to a calibrated engine speed setpoint.

If the second helm demand is above the idle threshold, as shown at 614, and the helm demand thereafter increases, the method further comprises continuing to recalculate the elevated engine speed setpoint based on the non-elevated engine speed setpoint and the filtered engine speed offset (see FIG. 3 and box 602) until a command to increase the helm demand to a subsequent helm demand corresponding to a subsequent engine speed setpoint that exceeds the elevated engine speed setpoint is received, as shown at 616. In response to receiving the command to increase the helm demand to the subsequent helm demand corresponding to the subsequent engine speed setpoint that exceeds the elevated engine speed setpoint, the method includes increasing the engine speed to the subsequent engine speed setpoint, as shown 612.

In other words, boxes 608, 610, and 612 describe how if the helm demand transitions from off-idle to on-idle and back to off-idle, the engine speed offset strategy is discontinued upon exceeding the idle threshold when transitioning from on-idle to off-idle. In contrast, boxes 614, 616, and 612 describe how if the engine speed setpoint is decreased from a higher off-idle value to a lower off-idle value and then subsequently increased, the engine speed offset strategy will be discontinued once the subsequent engine speed setpoint is greater than the elevated engine speed setpoint (which includes the engine speed offset). This provides a strategy in which the engine speed offset is "melted out," thus preventing the operator from noticing a speed discontinuity were the offset otherwise to be continued even after the subsequent engine speed exceeded the elevated engine speed.

How the system determines whether the offset needs to be melted out is described with respect to the logic diagram shown in FIG. 4. Referring to the lower right hand corner of FIG. 4, the non-elevated engine speed setpoint 52 is provided to a filter 56. In one example, the filter 56 is a first order exponential filter that operates according to the equation: $y(k)=a*y(k-1)+(1-a)*x(k)$, where $x(k)$ is the raw input at time step k; $y(k)$ is the filtered output at time step k; and "a" is a constant between 0 and 1. In one example, $a=\exp(-T/\tau)$, where $\tau$ is the filter time constant, and T is a fixed time step between samples.

The filter 56 is triggered upon input of the demand Δ being met, as shown at 58, i.e., the helm demand has been decreased by greater than the threshold demand Δ. On line 60, the filter 56 outputs an engine speed setpoint that includes an offset, and represents what the second helm demand's engine speed setpoint plus the offset would be. Meanwhile, the engine speed setpoint corresponding to the second helm demand (the non-elevated engine speed setpoint, not including the offset) is output on line 62. The setpoint plus offset on line 60 is subtracted from the setpoint without offset on line 62 at a subtractor 64. If the output from subtractor 64 is negative, the output is saturated to 0 and the engine speed offset strategy remains engaged. In other words, the setpoint plus offset on line 60 is greater than the setpoint without offset on line 62, and there is no need yet to melt out the offset. On the other hand, if the output from subtractor 64 is positive, the output along line 66 is added to the subsequent helm demand setpoint, shown at 68, by summer 70. The summation is compared to the elevated engine speed setpoint, shown at 72, by comparator 74. If the output of summer 70 is greater than the elevated engine speed setpoint 72, this means that the operator is now requesting an engine speed that is greater than what the engine speed offset strategy is outputting. The engine speed offset strategy will therefore be disabled (melted out) and the system will transition back to utilizing the base operator-requested engine speed setpoint. If the output of summer 70 is less than the elevated engine speed setpoint 72, the engine speed offset strategy will continue.

Therefore, the method disclosed herein includes comparing the elevated engine speed setpoint on line 60 to the non-elevated engine speed setpoint on line 62 and, in response to the elevated engine speed setpoint (line 60) being greater than the non-elevated engine speed setpoint (line 62), continuing to re-calculate the elevated engine speed setpoint based on the non-elevated engine speed setpoint and the filtered engine speed offset and setting the engine speed to the elevated engine speed setpoint. In other words, the engine speed offset strategy remains enabled. The method further includes calculating a difference between the elevated engine speed setpoint (line 60) and the non-elevated engine speed setpoint (line 62), and in response to the elevated engine speed setpoint (line 60) being less than the non-elevated engine speed setpoint (line 62), adding the difference between the elevated and non-elevated engine speed setpoints (line 66) to the subsequent engine speed setpoint 68. The subsequent engine speed setpoint 68 plus the difference between the elevated and non-elevated engine speed setpoints (line 66) is then compared with the elevated engine speed setpoint 72. In response to the subsequent engine speed 68 plus the difference between the elevated and non-elevated engine speed setpoints (line 66) (see summer 70) being greater than the elevated engine speed setpoint 72 (see comparator 74), the method includes setting the engine speed to the subsequent engine speed setpoint. In other words, the offset has been melted out.

Figure 7:
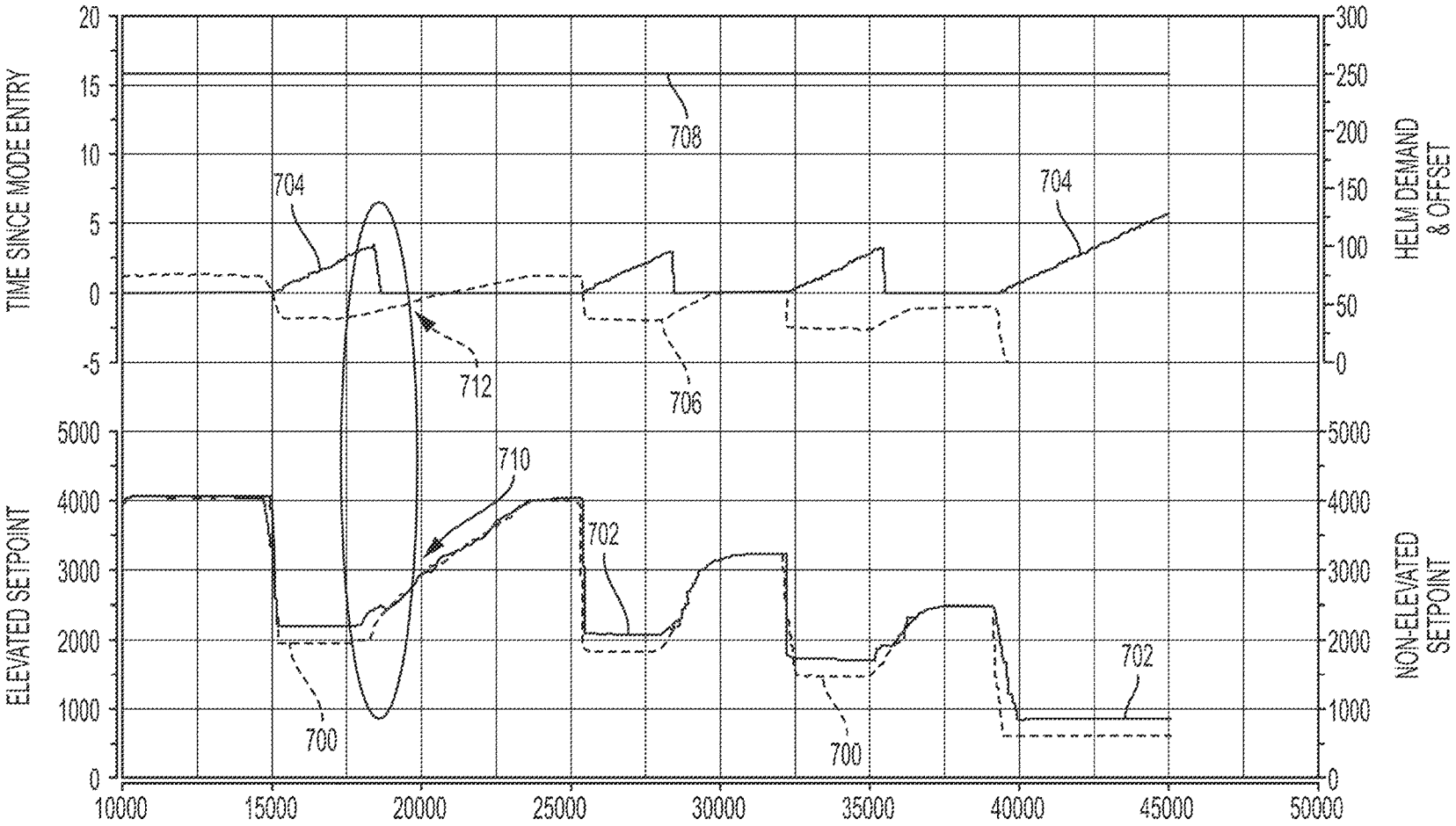
FIG. 7 illustrates a chart showing one example of the engine speed offset being melted-out from the engine speed setpoint.

One example of the result of using the melt out strategy is shown in FIG. 7. FIG. 7 shows a non-elevated engine speed setpoint at 700 and an elevated engine speed setpoint at 702 on the lower plot. Thus, the difference between the setpoints at 700 and 702 is the engine speed offset. The upper plot of FIG. 7 shows the time since mode entry (i.e., time since the engine speed offset algorithm has been enabled) at 704 and the helm demand at 706. The engine speed offset is shown at 708. As can be seen by the circled area, when the non-elevated engine speed setpoint 700 becomes greater than the elevated engine speed setpoint 702, as shown at 710, the melt out strategy is implemented, and the engine speed offset strategy is disabled. This can be observed by the fact that the time since mode entry 704 drops to zero seconds, as shown at 712, immediately after the non-elevated engine speed setpoint 700 becomes greater than the elevated engine speed setpoint 702.

Returning to FIG. 4, other details of the present method will be described. The method shown herein also includes an input regarding the gear of a transmission of the engine, as shown at 76. The method may include decreasing the engine speed to the non-elevated engine speed setpoint corresponding to the second helm demand if the transmission of the engine 12 is not in forward or reverse. In other words, if the transmission is not in-gear, and instead is in neutral or is indeterminate, the engine speed offset strategy may not be enabled. (See also FIG. 9 at 904.) The method may also include an input as to the time since mode entry, as shown at 80. The method may include decreasing the engine speed to the non-elevated engine speed setpoint corresponding to the second helm demand once a threshold filter time is exceeded. In other words, once the time since mode entry 80 exceeds the threshold filter time, the offset has been completely filtered out, and the engine speed returns to that corresponding to the position of the throttle lever (or corresponding to an input via another type of input device 20). The method may also include determining the pseudo boat speed, as described herein above with respect to FIG. 2, which input to the logic diagram is shown at 78. Each of the inputs 78, 44, 80, 76, 74, and 54 are provided to a state flow, represented at 82. If the state flow 82 determines that the engine speed offset strategy should be enabled, it may output the state as shown at 84. The second helm demand 48 and time since the threshold demand Δ has been met 46 may be used to calculate the engine speed offset 50 and the offset may be added to the non-elevated engine speed setpoint 52 as shown at 86 in order to determine the elevated engine speed setpoint 72.

Any of the above-described requirements for entry into the engine speed offset strategy could be used alone or in conjunction with one another in different sets. In one example, in order to enter the engine speed offset strategy, the helm demand must decrease by greater than the threshold demand Δ, the gear state must be in-gear (i.e., in forward gear or reverse gear), and the marine vessel must be operating in a given mode. Additionally, the subsequent helm demand must not be greater than the elevated engine speed setpoint. Any of the above-described requirements for exit from the engine speed offset strategy could also be used alone or in conjunction with one another in different sets. For example, the filter time may have expired, the gear state may not be in-gear, or the subsequent helm demand may be greater than the elevated engine speed setpoint. Alternatively, the system may be operating in other than the given mode, and the latch time may have expired. The example of the present method provided herein above responds not only when throttle is chopped to idle or near-idle speeds, but also in higher speed ranges, in response to throttle chops greater than a given threshold. Other exemplary methods may require that the throttle is chopped to a threshold near-idle speed before the engine offset strategy will run.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with one another and with other systems and methods. It is to be expected that various equivalents, alternatives and modifications are possible within the scope of the appended claims.

What is claimed is:

1. A method for temporarily elevating a speed of an engine in a marine propulsion system in response to a decrease in helm demand, the method comprising:

receiving, with a controller, a command to decrease the helm demand from a first helm demand to a second helm demand;

comparing a demand difference between the second helm demand and the first helm demand to a threshold demand delta; and in response to the demand difference exceeding the threshold demand delta:

tabulating a time since the demand difference exceeded the threshold demand delta;

determining an engine speed offset based upon the second helm demand and the time;

determining a non-elevated engine speed setpoint corresponding to the second helm demand;

calculating an elevated engine speed setpoint based on the non-elevated engine speed setpoint and the engine speed offset; and decreasing the engine speed to the elevated engine speed setpoint.

2. The method of claim 1, further comprising:

determining if the marine propulsion system is operating in a given mode; and setting the engine speed to the non-elevated engine speed setpoint corresponding to the second helm demand if the marine propulsion system is not operating in the given mode.

3. The method of claim 1, further comprising:

predicting a position of a throttle valve of the engine that is needed to achieve the elevated engine speed setpoint;

determining a feed forward signal that will move the throttle valve to the predicted position; and after moving the throttle valve to the predicted position, adjusting the engine speed with a feedback controller so as to obtain the elevated engine speed setpoint.

4. The method of claim 1, further comprising decreasing the engine speed to the non-elevated engine speed setpoint corresponding to the second helm demand if at least one of the following is true: (a) the demand difference does not exceed the threshold demand delta, and (b) a transmission of the engine is not in forward or reverse.

5. The method of claim 1, further comprising:

determining if the helm demand remains at the second helm demand; and as long as the helm demand remains at the second helm demand, filtering the engine speed offset and re-calculating the elevated engine speed setpoint based on the non-elevated engine speed setpoint and the filtered engine speed offset.

6. The method of claim 5, further comprising decreasing the engine speed to the non-elevated engine speed setpoint corresponding to the second helm demand once a threshold filter time is exceeded.

7. The method of claim 5, further comprising comparing the second helm demand to an idle threshold;

wherein if the second helm demand is below the idle threshold and the helm demand thereafter increases, the method further comprises:

continuing to re-calculate the elevated engine speed setpoint based on the non-elevated engine speed setpoint and the filtered engine speed offset until a command to increase the helm demand to a subsequent helm demand that exceeds the idle threshold is received; and in response to receiving the command to increase the helm demand to the subsequent helm demand that exceeds the idle threshold, increasing the engine speed to a subsequent engine speed setpoint corresponding to the subsequent helm demand.

8. The method of claim 5, further comprising comparing the second helm demand to an idle threshold;

wherein if the second helm demand is above the idle threshold and the helm demand thereafter increases, the method further comprises:

continuing to re-calculate the elevated engine speed setpoint based on the non-elevated engine speed setpoint and the filtered engine speed offset until a command to increase the helm demand to a subsequent helm demand corresponding to a subsequent engine speed setpoint that exceeds the elevated engine speed setpoint is received; and in response to receiving the command to increase the helm demand to the subsequent helm demand that corresponds to the subsequent engine speed setpoint that exceeds the elevated engine speed setpoint, increasing the engine speed to the subsequent engine speed setpoint.

9. The method of claim 8, further comprising:

comparing the elevated engine speed setpoint to the non-elevated engine speed setpoint; and in response to the elevated engine speed setpoint being greater than the non-elevated engine speed setpoint, continuing to re-calculate the elevated engine speed setpoint based on the non-elevated engine speed setpoint and the filtered engine speed offset and setting the engine speed to the elevated engine speed setpoint.

10. The method of claim 9, further comprising:

calculating a difference between the elevated engine speed setpoint and the non-elevated engine speed setpoint;

in response to the elevated engine speed setpoint being less than the non-elevated engine speed setpoint, adding the difference between the elevated and non-elevated engine speed setpoints to the subsequent engine speed setpoint;

comparing the subsequent engine speed setpoint plus the difference between the elevated and non-elevated engine speed setpoints with the elevated engine speed setpoint; and in response to the subsequent engine speed setpoint plus the difference between the elevated and non-elevated engine speed setpoints being greater than the elevated engine speed setpoint, setting the engine speed to the subsequent engine speed setpoint.

11. A method for temporarily elevating a speed of an engine in a marine propulsion system in response to a decrease in helm demand, the method comprising:

receiving, with a controller, a command to decrease the helm demand from a first helm demand to a second helm demand;

comparing a demand difference between the second helm demand and the first helm demand to a threshold demand delta; and determining if the marine propulsion system is operating in a given mode;

in response to the demand difference exceeding the threshold demand delta and the marine propulsion system operating in the given mode:

tabulating a time since the demand difference exceeded the threshold demand delta;

determining an engine speed offset based upon the second helm demand and the time;

determining a non-elevated engine speed setpoint corresponding to the second helm demand;

calculating an elevated engine speed setpoint based on the non-elevated engine speed setpoint and the engine speed offset; and decreasing the engine speed to the elevated engine speed setpoint.

12. The method of claim 11, further comprising setting the engine speed to the non-elevated engine speed setpoint corresponding to the second helm demand if the marine propulsion system is not operating in the given mode.

13. The method of claim 12, further comprising setting the engine speed to the non-elevated engine speed setpoint in response to the marine propulsion system not operating in the given mode for longer than a threshold latch time after having previously operated in the given mode.

14. The method of claim 12, further comprising:

determining if the helm demand remains at the second helm demand; and as long as the helm demand remains at the second helm demand, filtering the engine speed offset and re-calculating the elevated engine speed setpoint based on the non-elevated engine speed setpoint and the filtered engine speed offset.

15. The method of claim 14, further comprising comparing the second helm demand to an idle threshold;

wherein if the second helm demand is below the idle threshold and the helm demand thereafter increases, the method further comprises:

continuing to re-calculate the elevated engine speed setpoint based on the non-elevated engine speed setpoint and the filtered engine speed offset until a command to increase the helm demand to a subsequent helm demand that exceeds the idle threshold is received; and in response to receiving the command to increase the helm demand to the subsequent helm demand that exceeds the idle threshold, increasing the engine speed to a subsequent engine speed setpoint corresponding to the subsequent helm demand; or wherein if the second helm demand is above the idle threshold and the helm demand thereafter increases, the method further comprises:

continuing to re-calculate the elevated engine speed setpoint based on the non-elevated engine speed setpoint and the filtered engine speed offset until a command to increase the helm demand to a subsequent helm demand corresponding to a subsequent engine speed setpoint that exceeds the elevated engine speed setpoint is received; and in response to receiving the command to increase the helm demand to the subsequent helm demand that corresponds to the subsequent engine speed setpoint that exceeds the elevated engine speed setpoint, increasing the engine speed to the subsequent engine speed setpoint.

16. The method of claim 15, further comprising:

comparing the elevated engine speed setpoint to the non-elevated engine speed setpoint;

calculating a difference between the elevated engine speed setpoint and the non-elevated engine speed setpoint; and in response to the elevated engine speed setpoint being greater than the non-elevated engine speed setpoint, continuing to re-calculate the elevated engine speed setpoint based on the non-elevated engine speed setpoint and the filtered engine speed offset and setting the engine speed to the elevated engine speed setpoint; or in response to the elevated engine speed setpoint being less than the non-elevated engine speed setpoint, adding the difference between the elevated and non-elevated engine speed setpoints to the subsequent engine speed setpoint, and in response to the subsequent engine speed setpoint plus the difference between the elevated and non-elevated engine speed setpoints being greater than the elevated engine speed setpoint, setting the engine speed to the subsequent engine speed setpoint.

17. A method for temporarily elevating a speed of an engine in a marine propulsion system in response to a decrease in helm demand, the method comprising:

receiving, with a controller, a command to decrease the helm demand from a first helm demand to a second helm demand;

comparing a demand difference between the second helm demand and the first helm demand to a threshold demand delta; and in response to the demand difference exceeding the threshold demand delta:

tabulating a time since the demand difference exceeded the threshold demand delta;

determining an engine speed offset based upon the second helm demand and the time;

determining a non-elevated engine speed setpoint corresponding to the second helm demand;

calculating an elevated engine speed setpoint based on the non-elevated engine speed setpoint and the engine speed offset;

decreasing the engine speed to the elevated engine speed setpoint;

subsequently determining if the helm demand remains at the second helm demand; and as long as the helm demand remains at the second helm demand, filtering the engine speed offset and re-calculating the elevated engine speed setpoint based on the non-elevated engine speed setpoint and the filtered engine speed offset;

wherein in response to a command to increase the helm demand to a subsequent helm demand, the controller determines when to transition from setting the engine speed to the elevated engine speed setpoint to setting the engine speed to the non-elevated engine speed setpoint based on whether the second helm demand is above or below an idle threshold.

18. The method of claim 17, wherein:

in response to the second helm demand being below the idle threshold and the subsequent helm demand exceeding the idle threshold, the method further comprises increasing the engine speed to a subsequent engine speed setpoint corresponding to the subsequent helm demand; and in response to the second helm demand being above the idle threshold and the subsequent helm demand exceeding the elevated engine speed setpoint, the method further comprises increasing the engine speed to the subsequent engine speed setpoint corresponding to the subsequent helm demand.

19. The method of claim 17, further comprising filtering the engine speed offset according to a calibrated first order filter.

20. The method of claim 19, wherein an initial value of the engine speed offset is directly related to the second helm demand.

* * * * *